United States Patent [19]

Hogen Esch et al.

[11] Patent Number: 4,847,592

[45] Date of Patent: Jul. 11, 1989

[54] DETECTION PLATE HAVING PIN-SHAPED ATTACHMENT MEANS

[75] Inventors: Johannes H. L. Hogen Esch, Aalten; Hendrik J. de Jong, Groenlo, both of Netherlands

[73] Assignee: N.V. Nederlandsche Apparatenfabriek Nedap, Groenlo, Netherlands

[21] Appl. No.: 155,435

[22] Filed: Feb. 12, 1988

Related U.S. Application Data

[63] Continuation-in-part of Ser. No. 874,005, Jun. 13, 1986, Pat. No. 4,742,341.

[30] Foreign Application Priority Data

Jun. 14, 1985 [NL] Netherlands ..... 8501721
Mar. 10, 1987 [NL] Netherlands ..... 8700563

[51] Int. Cl.[4] ..... G08B 13/24

[52] U.S. Cl. ..... 340/572; 340/573; 340/693; 343/894; 343/895

[58] Field of Search ..... 340/572, 693, 573; 343/895, 894

[56] References Cited

U.S. PATENT DOCUMENTS 3,713,133 1/1973 Nathans ..... 340/572
4,742,341 5/1988 Hogen Esch ..... 343/895

*Primary Examiner*—Glen R. Swann, III
*Attorney, Agent, or Firm*—Fleit, Jacobson, Cohn, Price, Holman & Stern

[57] ABSTRACT

In a detection plate, an electronic circuit capable of being activated by a suitable interrogation field to generate a pre-determined signal is provided with pin-shaped attachment means arranged so that the unauthorized detachment of the attachment means results in the interruption of an electrical conductor forming part of said electronic circuit. In the embodiment the detection plate is an earmark for animals and the attachment means includes a pin integral with the plate. The pin has a point which can be pushed through an animal's ear and the device can then be fastened on the other side of the ear. The pin includes a conductive loop which extends into the point and is connected to the electronic circiut of the plate.

11 Claims, 1 Drawing Sheet

DETECTION PLATE HAVING PIN-SHAPED ATTACHMENT MEANS

This is a continuation in part of U.S. Ser. No. 874,005, filed June 13, 1986, now U.S. Pat. No. 4,742,341.

BACKGROUND OF THE INVENTION

1. Field of the Invention

This invention relates to a detection plate comprising an electronic circuit capable of being activated by a suitable interrogation field to generate a pre-determined signal, said plate having pin-shaped attachment means.

2. Description of Related Art

Such detection plates can be used in various situations. One known application of such detection plates or tags is in anti-shop-lifting systems. The articles to be protected are then each provided with a tag which is secured with a pin-shaped member to the articles to be protected. In the vicinity of the exits of the shop, a detector is installed, which generates a suitable interrogation field. Normally the tag is removed by shop attendants at the pay desk. If this is not done, the tag is activated by the interrogation field at an exit, and a signal is generated which can be detected by the detector. This signal may be a coded signal, but in the case of anti-shop-lifting systems is mostly composed of one or a few pre-determined frequencies.

Detection plates of the kind described can also be used in automating certain operations. Thus articles may, for example, be provided with a label which in a suitable interrogation field generates a specific code signal. This code may, for example, be recognized in a reading station, whereafter it can be determined in what manner this specific article is to be further treated. The further treatment may include, for example, a sorting action, a special operation, etc.

Detection plates of the kind described can also be used for the automatic recognition of cattle. Each animal is then provided with a tag, mostly taking the form of an earmark, which in a suitable interrogation field generates a specific code. The animal can thus, for example, be automatically recognized at a feeding trough, whereafter it is administered a pre-determined quantity of food under the control of a computer program.

Now, in all these cases, a non-authorized person can destructively remove the label or tag, although often with much difficulty, as result of which the animal or article concerned can no longer be automatically recognized when it passes the detector provided for the purpose. This is usually highly undesirable in conducting the operations in question, and in addition creates possibilities of fraud such as, in the example first mentioned, shop-lifting. In the last-mentioned example, fraud would be possible by, for example, transferring the specific earmark from a valuable animal to the ear of an animal of inferior quality, and subsequently selling the latter animal at too high a price.

SUMMARY OF THE INVENTION

According to the present invention, the adverse effect of unauthorized removal is prevented by ensuring by means of particular constructive measures that the unauthorized removal always leads to the situation that the signal generated by the detection plate is modified or can no longer be transmitted at all. Unauthorized re-use has thus become useless; and sometimes the person committing the fraud can be detected and localized.

According to the present invention, a detection plate of the above kind is characterized by said attachment means being arranged so that the unauthorized detachment of the attachment means results in the interruption of an electrical conductor forming part of said electronic circuit.

BRIEF DESCRIPTION OF THE DRAWINGS

The invention will now be described in more detail with reference to the accompanying drawings of some exemplary embodiments. In said drawings.

DETAILED DESCRIPTION

Figure 1:
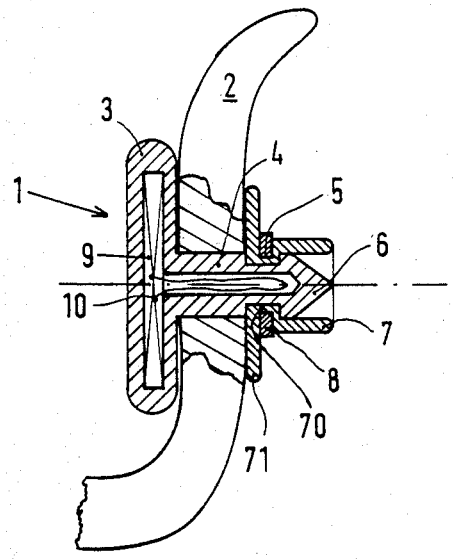
FIG. 1 shows schematically and by way of example a first embodiment of the invention, i.e. an earmark for use with animals.

FIG. 1 shows how an earmark 1 is secured in the ear 2 of, for example a cow. The earmark 1 comprises a disk-shaped housing 3 of synthetic plastic with an integral pin 4 provided with a reduced diameter groove portion 5 just behind a sharp point 6. After the ear tissue has been pierced with pin 4, so that the point 6 and the reduced diameter portion 5 emerge at the other side, a member 7 is put in place. The member 7 is a cup-shaped lock-member which is made of flexible stretchable material, e.g. rubber. The bottom of the cup-shaped member 7 has a central hole and a short neck 70 which connects the bottom to a rather large flange 71, which in use lies against the ear of the animal. The bottom, the neck 70 and the large flange 71 in use just fill the groove portion 5 of the pin 4. The lock-member 7 is locked by a strong metal ring 8, which is mechanically shrunk around the neck 70. Housing 3 and pin 4 are hollow; the housing contains an electronic identification circuit 9, and a wire loop 10 is passed through pin 4 as far as the point 6. This wire loop 10 constitutes part of the wiring of the electronic identification circuit.

When an animal carrying such an earmark is within the reach of the electromagnetic interrogation field of a detection device, the identification circuit 9 in the earmark becomes active in known manner, and transmits a specific code which unequivocally identifies the earmark in question and hence the animal in question, which is recognized by the detection device. The earmark can only be removed by cutting pin 4. In fact, lock-member 7 cannot be removed owing to the presence of the strong metal ring 8. However, cutting pin 4 be it just behind the point 6 or at the other side of the ear, inevitably results in wire loop 10, and hence a portion of the identification circuit 9, being interrupted, too. Depending on the application, the result of this can be:

a. the identification circuit 9 in the earmark becomes inoperative, so that re-use becomes useless; or b. the code of the identification circuit 9 is changed (e.g. because loop 10 constitutes part of the memory circuit of the identification circuit 9 in which the code is recorded), as a result of which unauthorized re-use is detected at the next detection moment. In such a case, for example, a fraudulent user may be traced.

Figure 2:
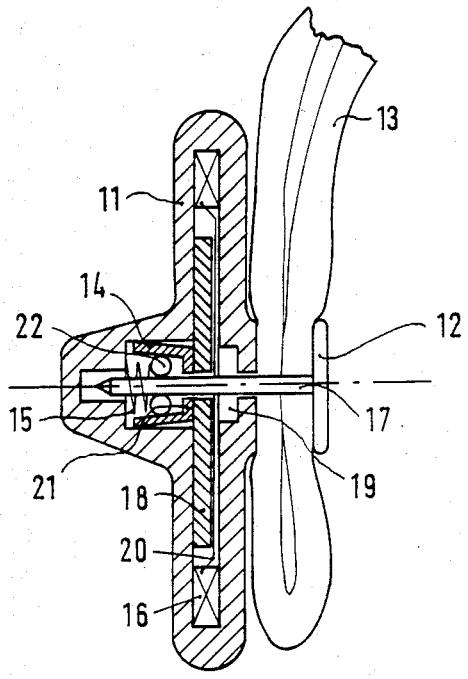
FIG. 2 shows schematically an example of an anti-theft label, for example, for clothing in shops.

FIG. 2 shows a label responder 11, which by means of a headed pin or nail 12 is secured to a piece of clothing 13. For this purpose, label 11 is hollow, in known manner, and contains a conical cupor bushing 14 with a ball lock 15. The ball lock 15 comprises release means, not shown, which can only be operated by an authorized person by means of a special device, for example, after the protected piece of clothing 13 has been paid for at the desk.

Label 11 further comprises an identification circuit 16. This circuit 16 is activated within the electromagnetic field of a detection device, which may be provided at the exit of a shop, so that detection takes place there. The activation of the identification circuit 16 in the label may result in the transmission of a specific code (in the same way as described for the earmark embodiment, FIG. 1). But, also, the activation may result in resonation of a resonance circuit of the identification circuit 16 at a specific frequency. In that case, the identification circuit 16 comprises a coil and a capacitor connected across it. The coil preferably then also serves as a receiving antenna of the identification circuit 16 in label 11.

Fraudulent removal of label 11 can only take place by removing or cutting through nail 12, which requires a substantial force. In both cases a high tensile stress is generated in shank 17 of nail 12, also when it is cut through, because the jaws of a pair of nippers must be pushed between the nail head and the piece of clothing 13.

In the present example, the fraudulent removal is rendered detectable as follows:

Disposed in the cavity of label 11 is a frangible strip 18 of a relatively brittle, insulating synthetic plastic. The conical cup or bushing 14 is supported with its bottom 21 on this strip, which is provided with a hole to permit the passage of shank 17 of nail 12. On the other side of strip 18, label housing 11 has a cavity 19 with a diameter just a little larger than the diameter of the bottom of bushing 14. Furthermore, a thin conductive track or path 20 is provided on strip 18, which forms part of the electrical circuit of identification circuit 16. If now, fraudulently, nail 12 is pulled out or shank 17 is cut through, part of the shank 17 will be firmly held by the balls 22 in the cup 14 and therefore strip 18 will be broken owing to the large forces occurring and exerted thereon via cup 14. But then the thin conductive path 20 is interrupted as well, and hence identification circuit 16 is influenced. The result is, for example, a change in the transmitted code (as with the above earmark) or a change in the resonance frequency.

By providing detection systems at appropriate places (e.g. in fitting rooms) of the clothing shop, such a changed code or resonance frequency can immediately be detected, whereby the fraud is not only detected, but also located.

Naturally, the possibilities of the invention are not limited to the examples described above. Thus the identification circuit incorporated in the label need not operate purely electronically, but a known per se electroacoustic circuit can be built in. Also, the code altered or absent owing to fraud may in certain cases be restorable in an authorized manner, so that (for example for anti-shop-lifting systems), the label can be re-used.

What I claim is:

1. A detection plate formed as an earmark and comprising an electronic circuit capable of being activated by a suitable interrogation field to generate a pre-determined signal, said plate also having pin-shaped attachment means arranged so that the unauthorized detachment of the attachment means results in the interruption of an electrical conductor forming part of said electronic circuit, and said attachment means including a pin integral with the plate and having a point which can be pushed through an ear and fastened on the other side of the ear, said pin including a conductive loop extending into the point and connected to said electronic circuit.

2. The detection plate as claimed in claim 1, wherein said pin is hollow.

3. The detection plate as claimed in claim 1, wherein said pin includes adjacent to its point a portion of reduced diameter arranged to cooperate with a retaining means.

4. The detection plate as claimed in claim 3, wherein the retaining means comprises a stretchable cup-shaped member with a pierced bottom contiguous with a short tubular part which in turn is contiguous with a flange which, in use, is in contact with the ear, the tubular part being, in use, housed in the portion of the pin of reduced diameter and anchored by means of a metal shrunk-on ring.

5. The detection plate as claimed in claim 1, wherein the electronic circuit is arranged so that the interruption of the electrical conductor prevents further activation of the electronic circuit.

6. The detection plate as claimed in claim 1, wherein the electronic circuit is an identification circuit which when activated will generate a code signal corresponding to the pre-determined signal, and the electronic circuit is arranged so that the interruption of the electrical conductor will result in a changed code of the code signal.

7. A detection plate comprising an electronic circuit capable of being activated by a suitable interrogation field to generate a pre-determined signal, said plate also having pin-shaped attachment means arranged so that the unauthorized detachment of the attachment means results in the interruption of an electrical conductor forming part of said electronic circuit, and said attachment means comprising a headed pin having a shank capable of cooperating with a ball lock in the plate, the ball lock comprising a ball holder resting against a strip of frangible material with said electrical conductor being a conductive track provided on the frangible material.

8. The detection plate as claimed in claim 7, wherein, on the side of the frangible strip away from the ball holder, the detection plate has a recess in alignment with said ball holder.

9. The detection plate as claimed in claim 7, wherein the electronic circuit is arranged so that the interruption of the electrical conductor prevents further activation of the electronic circuit.

10. The detection plate as claimed in claim 7, wherein the electronic circuit is an identification circuit which when activated will generate a code signal corresponding to the predetermined signal, and the electronic circuit is arranged so that the interruption of the electrical conductor will result in a changed code of the code signal.

11. A detection plate comprising an electronic circuit capable of being activated by a suitable interrogation field to generate a pre-determined signal, said plate also having pin-shaped attachment means arranged so that the unauthorized detachment of the attachment means results in the interruption of an electrical conductor forming part of said electronic circuit, and the electronic circuit being arranged so that the interruption of the electrical conductor prevents further activation of the electronic circuit.

* * * * *